United States Patent [19]

Keith

[11] Patent Number: 5,067,703

[45] Date of Patent: Nov. 26, 1991

[54] AUTOMATIC PALLET CENTERING DEVICE

[75] Inventor: Malcolm E. Keith, West Chicago, Ill.

[73] Assignee: Midaco Corporation, Elk Grove Village, Ill.

[21] Appl. No.: 569,647

[22] Filed: Aug. 20, 1990

[51] Int. Cl.[5] ..... B65H 1/22

[52] U.S. Cl. ..... 271/164; 271/147

[58] Field of Search ..... 271/145, 147, 162, 164

[56] References Cited

U.S. PATENT DOCUMENTS

| | | | |
|---|---|---|---|
| 3,987,911 | 10/1976 | Euverard et al. | 271/164 |
| 4,245,830 | 1/1981 | Fichte et al. | 271/164 |
| 4,635,924 | 1/1987 | Pollich | 271/164 |
| 4,811,939 | 3/1989 | Keith | 271/146 |

*Primary Examiner*—H. Grant Skaggs
*Assistant Examiner*—Steven Rein

[57] ABSTRACT

The present invention provides an automatic pallet centering device so that the pallet can retract into the floor. A pair of centering switches are utilized which engage a bottom portion of the pallet support so as to center the device.

2 Claims, 2 Drawing Sheets

AUTOMATIC PALLET CENTERING DEVICE

BACKGROUND OF THE INVENTION

1. Field of the Invention

This invention relates in general to a moveable table for feeding paper or cardboard to a printing press and in particular to a self-centering switch and motor arrangement.

2. Description of the Prior Art

This invention is an improvement on patent 4,811,939 of which the description and drawings are hereby incorporated by reference. The present invention provides for an automatic centering circuit which is incorporated in the prior art printing platform described in U.S. Pat. No. 4,811,939.

SUMMARY OF THE INVENTION

The present invention provides for a self-centering circuit which has two switches which engage a portion of the pallet support such that if only one of the switches engages the pallet support, a centering motor is actuated to drive the pallet support until both switches engage the pallet support which occurs when the pallet is centered. Thus, the present invention comprises an automatic centering arrangement.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure, and in which:

DESCRIPTION OF THE PREFERRED EMBODIMENTS

Figure 1:
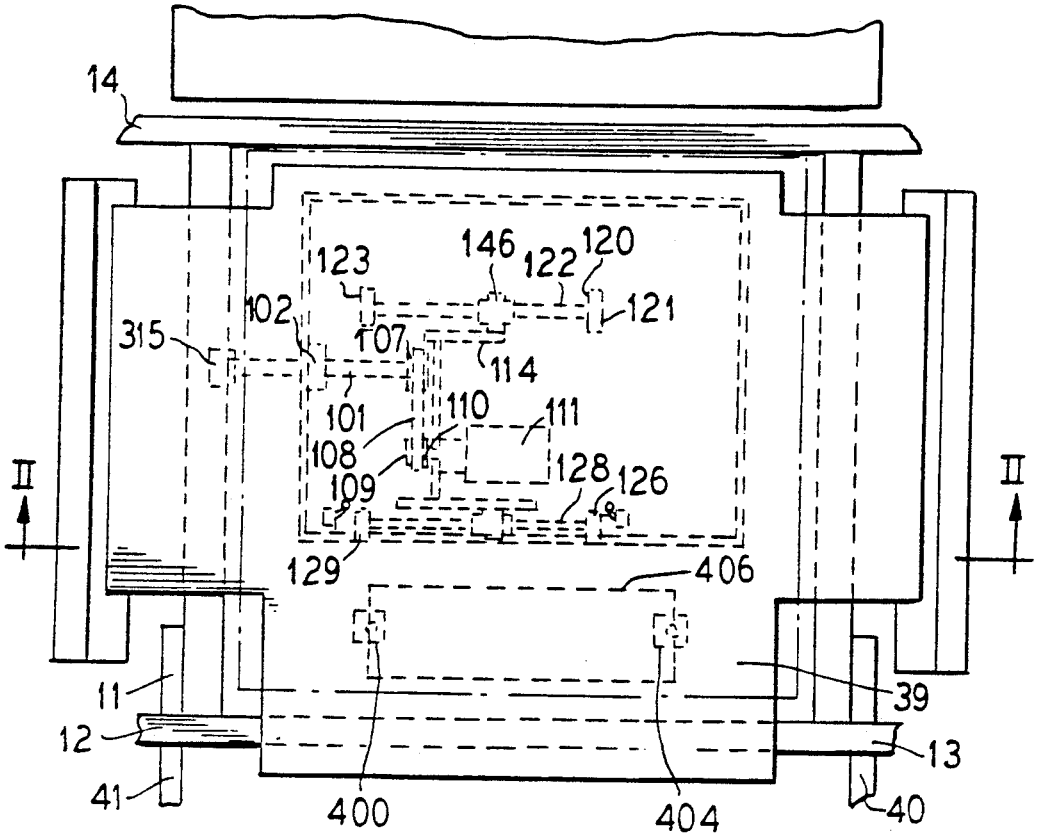
FIG. 1 is a top plan view illustrating the self-centering circuit of the invention.
Figure 3:
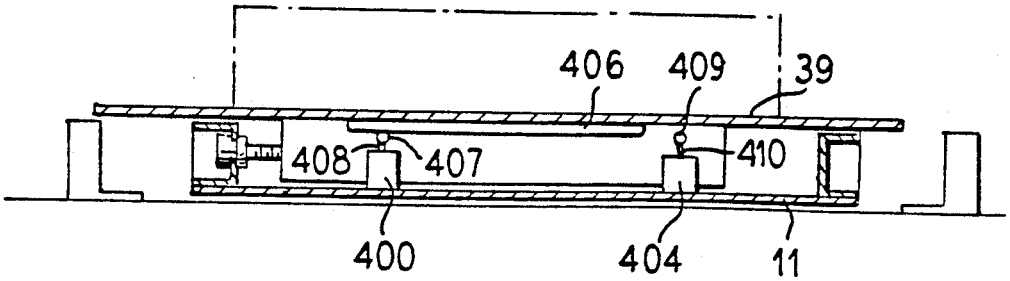
FIG. 3 is a side plan view illustrating the pallet in the non-centered position.

FIG. 1 is a partial view illustrating the structure from a top plan view similar to FIG. 3 of U. S. Pat. No. 4,811,939 which comprises an inner table 39 which is moveable relative to an outer table 11. A pair of hydraulic cylinders is not shown in FIG. 1, but clearly shown in FIG. 3 of U.S. Pat. No. 4,811,939 control the vertical position of the inner table 39 relative to the outer table 11 relative to FIG. 1. A motor 111 controls the transverse position of the inner table 39 relative to the outer table 11 as described in U.S. Pat. No. 4,811,939. Generally, the motor 111 is attached to the inner table 39 and has an output shaft 110 which carries a pulley 109 that drives a belt 108 that passes around a pulley 107 mounted on a threaded shaft 101 which passes through a threaded collar 102 attached to the inner table 39. The shaft 101 is rotatably supported in a bearing 315 attached to the outer table 111. A pair of guides 122 and 128 are mounted by supports 123 and 120 and 129 and 126 so as to guide the inner table as the motor 111 rotates. If the motor rotates in one direction, the inner table moves to the right relative to FIG. 1 and if the motor 111 rotates in the other direction the inner table moves to the left relative to FIG. 1.

Figure 2:
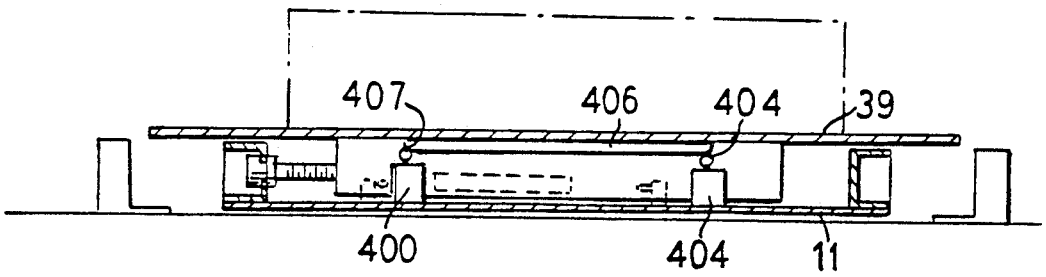
FIG. 2 is a side plan view of the self-centering circuit illustrating the pallet in the centered position taken on line II—II of FIG. I.

The automatic centering mechanism of the invention is illustrated in side sectional views of FIGS. 2 and 3 wherein FIG. 2 illustrates the inner table 39 centered relative to the outer table Il and in this position a bar 406 attached to the undersurface of the inner table 39 engages a pair of switches 400 and 404 which are laterally spaced from each other and are supported by the outer table 11. When the bar 406 engages the switches 400 and 404, it opens the switches and when the bar does not engage the switches, the switches are closed.

FIG. 3 illustrates the non-centered position wherein the inner table 39 is to the left of center such that switch 400 engages the bar 406, but the switch 404 does not engage the bar 406 so that the switch 404 is closed. The switch 400 has a shaft 408 which supports a roller 407 which is engageable with the bar 406 and the switch 404 has a shaft 410 which carries a roller 409 engageable by the bar 406.

Figure 4:
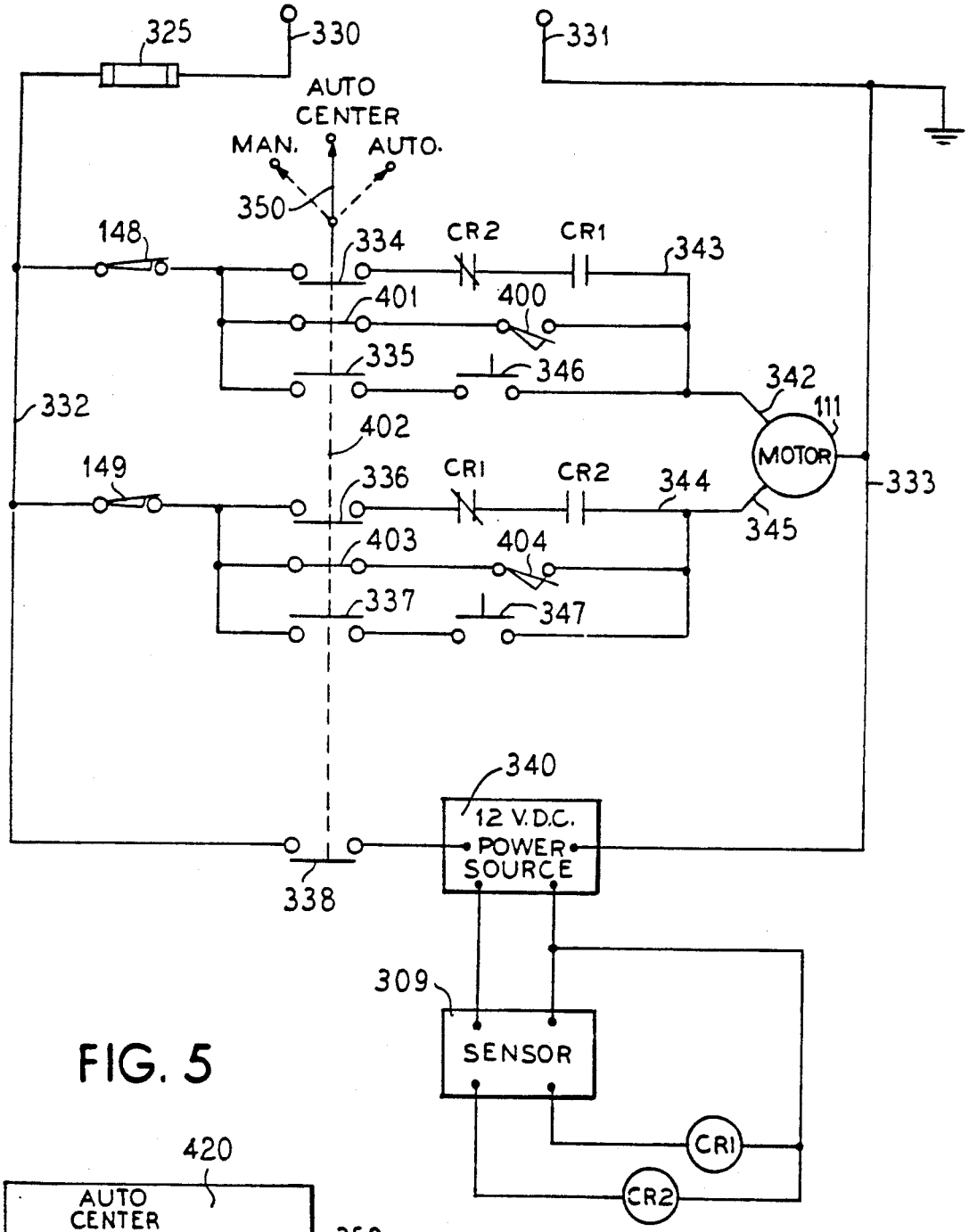
FIG. 4 is an electrical schematic of the self-centering circuit of the invention.

FIG. 4 is an electrical schematic of the improvement of the invention and FIG. 4 is similar to FIG. 8 of U.S. Pat. No. 4,811,939 except that it includes the additional circuitry required for the automatic centering circuit of the present invention.

U.S. Pat. No. 4,811,939 discloses a switch 341 which can be moved to three positions, a manual, an off and an auto position. In the present invention, the switch 350 can also be moved to manual and the auto positions which are identical to that shown in FIG. 8 of U.S. Pat. No. 4,811,939. Switch 350 of the invention also has a third position which is automatic centering indicated as "auto center" and in this position, the shaft 402 of the switch 350 open switch 334 and closes the switch 401 and opens the switch 335 and opens the switch 336 and closes the switch 403 and opens the switch 337 and switch 338. The switch 401 is connected through switch 148 to lead 332 and fuse 325 to power lead 330 to automatic centering switch 400 which has its other contact connected to lead 342 of motor 111. The switch 403 when closed is connected through the switch 149 to lead 332 and fuse 325 to lead 330 and is also connected to the centering switch 404 which has its other contact connected to lead 345 of the motor 111. The third lead of the motor 111 is connected to ground by lead 333. If the inner table is centered as illustrated in FIG. 2, the bar 406 will engage the rollers 407 and 409 of the switches 400 and 404 and the switches will both be opened and the motor 111 will not rotate in either direction. If the bar 406 and the inner table 39 are not centered, one of the switches 400 or 404 will be closed as, for example, illustrated in FIG. 3 switch 404 is closed since its roller 409 does not engage the bar 406 and thus power will be applied to lead 345 of the motor 111 to cause it to rotate in a direction to move the bar 406 in a direction so it engages the roller 409 and open switch 404. When the switch 404 is opened, then the motor stops and the inner table 39 is centered. If the bar 406 and the inner table 39 are to the right of center relative to FIG. 3 power will be supplied to lead 342 of the motor to cause it to rotate in the opposite direction so that it centers the inner table 39 which will cause the bar 406 to engage the roller 407 to open switch 400 and thus stop the motor when centering has occurred.

Figure 5:
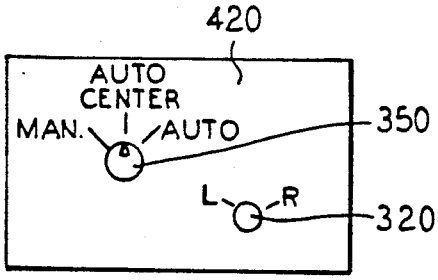
FIG. 5 illustrates the control for the invention.

FIG. 5 is a detail plan view illustrating the switch 350 on a control panel 420 which also has left and right jog switch 320 for the cylinders so as to move the inner table 39 up and down relative to FIG. 1. This structure is shown in U.S. Pat. No. 4,811,939.

Although the invention has been described with respect to preferred embodiments, it is not to be so limited as changes and modifications can be made which are within the full intended scope of the invention as defined by the appended claims.

I claim as my invention:

1. A composite table for supporting sheets for a machine comprising an outer table, an inner table moveably mounted to said outer table so as to be moveable relative thereto, a reversible motor coupled to said outer and inner table so as too move them relative to each other, a bar mounted on said inner table, first and second spaced auto-centering switches mounted on said outer table and each engageable with said bar when said inner table is centered relative to said outer table, an auto-center switch for said first and second auto-centering switches in circuit with different windings of said reversible motor such that if said first auto-centering switch does not engage said bar it is closed to supply power to said reversible motor to rotate in a first direction to center said inner table relative to said outer table and said auto-center switch having an auto-center setting such that regardless of the vertical position of the composite table, the table will center itself.

2. A composite table according to claim 1 wherein if said second auto-centering switch does not engage said bar it is closed to supply power to said reversible motor to rotate it in a second direction to center said inner table relative to said outer table.

* * * * *